US007578131B2

(12) United States Patent
Muldoon et al.

(10) Patent No.: US 7,578,131 B2
(45) Date of Patent: Aug. 25, 2009

(54) AUGMENTOR SPRAY BAR MOUNTING

(75) Inventors: Marc J. Muldoon, Marlborough, CT (US); Tor W. Sherwood, San Diego, CA (US); Meggan H. Harris, Colchester, CT (US); Robert T. Brooks, Killingworth, CT (US)

(73) Assignee: United Technologies Corporation, Hartford, CT (US)

( * ) Notice: Subject to any disclaimer, the term of this patent is extended or adjusted under 35 U.S.C. 154(b) by 0 days.

(21) Appl. No.: 11/174,378

(22) Filed: Jun. 30, 2005

(65) Prior Publication Data

US 2007/0028621 A1 Feb. 8, 2007

(51) Int. Cl.
*F02K 3/10* (2006.01)

(52) U.S. Cl. ..... 60/761; 60/765

(58) Field of Classification Search ..... 60/761–766; 277/630, 637, 496, 497, 498, 499, 631, 626, 277/627, 644, 650
See application file for complete search history.

(56) References Cited

U.S. PATENT DOCUMENTS 2,523,741 A * 9/1950 Weschler et al. ..... 248/56
3,793,838 A * 2/1974 Nash ..... 60/764
5,385,015 A 1/1995 Clements et al.
5,685,140 A 11/1997 Clements et al.
2005/0084190 A1 4/2005 Brooks et al.

FOREIGN PATENT DOCUMENTS

CN 85205003 U 9/1986

* cited by examiner

*Primary Examiner*—Michael Cuff
*Assistant Examiner*—Gerald L Sung
(74) *Attorney, Agent, or Firm*—Bachman & LaPointe, P.C.

(57) ABSTRACT

A gas turbine engine augmentor has a centerbody within a gas flowpath from upstream to downstream. The augmentor has upstream and downstream shell sections, a downstream rim of the upstream shell section meeting an upstream rim of the downstream shell section shell section. A plurality of vanes are positioned in the gas flowpath outboard of the centerbody. An augmentor spray bar fuel conduit extends through the centerbody and a first of the vanes to deliver fuel to the centerbody. A seal is mounted to the spray bar and positioned in a recess extending from at least one of the downstream rim of the upstream shell section and upstream rim of the downstream shell section shell section. The seal has a first portion and a second portion engaging the first portion in a back-locked interfitting.

10 Claims, 7 Drawing Sheets

AUGMENTOR SPRAY BAR MOUNTING

U.S. GOVERNMENT RIGHTS

The invention was made with U.S. Government support under contract N00019-02-C-3003 awarded by the U.S. Navy. The U.S. Government has certain rights in the invention.

BACKGROUND OF THE INVENTION

This invention relates to turbine engines, and more particularly to turbine engine augmentors.

Afterburners or thrust augmentors are known in the industry. A number of configurations exist. In a typical configuration, exhaust gases from the turbine pass over an augmentor centerbody. Additional fuel is introduced proximate the centerbody and is combusted to provide additional thrust. In some configurations, the augmentor centerbody is integrated with the turbine centerbody. In other configurations, the augmentor centerbody is separated from the turbine centerbody with a duct surrounding an annular space between the two. U.S. Pat. Nos. 5,685,140 and 5,385,015 show exemplary integrated augmentors.

The centerbody may contain a burner serving as a combustion source. For introducing the additional fuel, a number of spray bars may be positioned within generally radially extending vanes. A pilot may be proximate an upstream end of the tailcone. Alternatively or additionally to the burner, a number of igniters may be positioned within associated ones of the vanes to ignite the additional fuel. Trailing portions of the vanes may serve as flameholder elements for distributing the flame across the flow path around the centerbody.

Separately, electro-graphitic carbon materials have been developed for a variety of uses. US Pre-grant Publication 20050084190A1 discloses a variable vane inner diameter (ID) bushing made from electro-graphitic carbon.

SUMMARY OF THE INVENTION

Accordingly, one aspect of the invention involves a turbine engine. A centerbody is positioned within a gas flowpath from upstream to downstream. The augmentor has upstream and downstream shell sections, a downstream rim of the upstream shell section meeting an upstream rim of the downstream shell section shell section. A plurality of vanes are positioned in the gas flowpath outboard of the centerbody. An augmentor spray bar fuel conduit extends through the centerbody and a first of the vanes to deliver fuel to the centerbody. A seal is mounted to the spray bar and positioned in a recess extending from at least one of the downstream rim of the upstream shell section and upstream rim of the downstream shell section shell section. The seal has a first portion and a second portion engaging the first portion in a backlocked interfitting.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
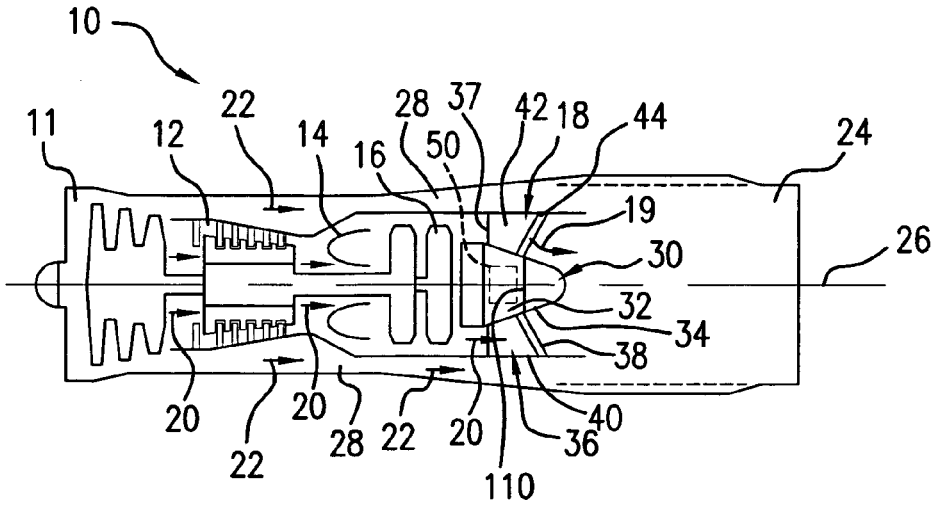
FIG. 1 is a schematic longitudinal sectional view of an aircraft powerplant.

FIG. 1 shows a gas turbine engine 10 comprising, from upstream to downstream and fore to aft, a fan 11, a compressor 12, a combustor 14, a turbine 16, and an augmentor 18. Air entering the fan 11 is divided between core gas flow 20 and bypass air flow 22. Core gas flow 20 follows a path initially passing through the compressor 12 and subsequently through the combustor 14 and turbine 16. Finally, the core gas flow 20 passes through the augmentor 18 where additional fuel 19 is selectively added, mixed with the flow 20, and burned to impart more energy to the flow 20 and consequently more thrust exiting an engine nozzle 24. Hence, core gas flow 20 may be described as following a path essentially parallel to the axis 26 of the engine 10, through the compressor 12, combustor 14, turbine 16, and augmentor 18. Bypass air 22 also follows a path parallel to the axis 26 of the engine 10, passing through an annulus 28 along the periphery of the engine 10 to merge with the flow 20 at or near the nozzle 24.

Figure 2:
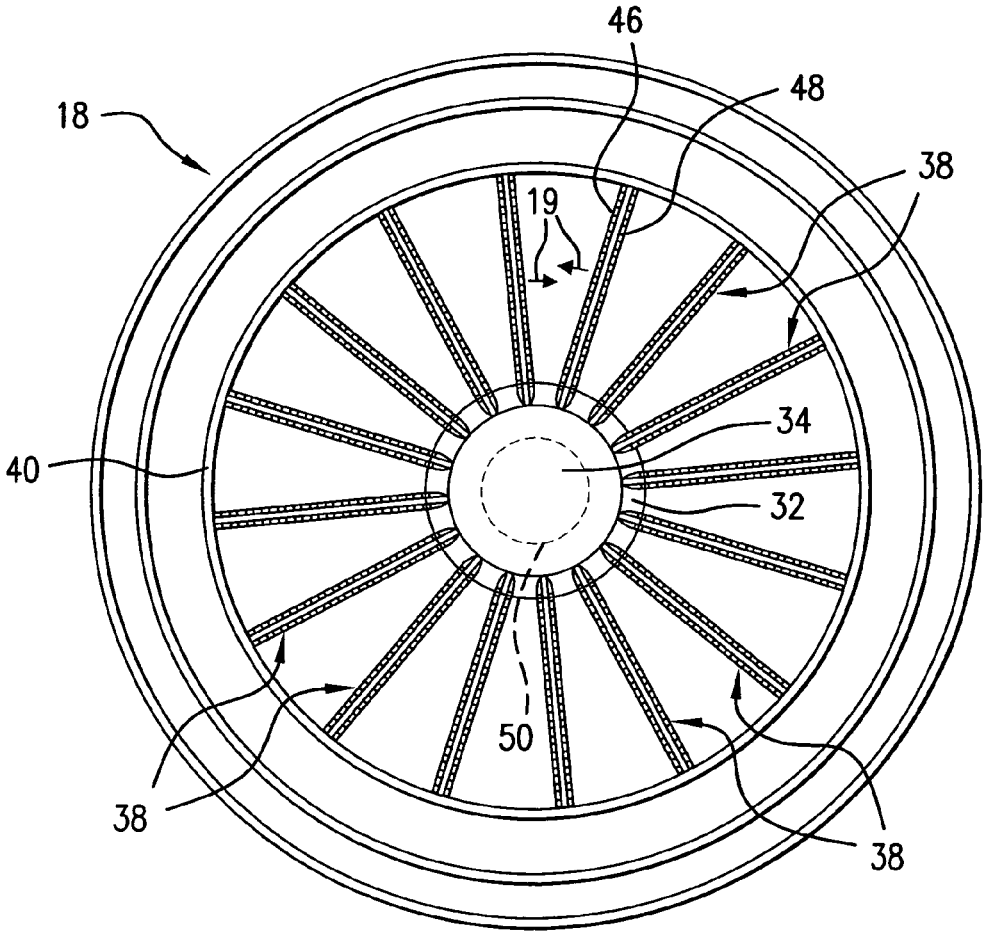
FIG. 2 is an aft view of an augmentor of the powerplant of FIG. 1.

The augmentor comprises a centerbody 30 generally symmetric around the axis 26 and formed as a portion of an engine hub. The exemplary centerbody has a main portion 32 and a tailcone 34 downstream thereof. Circumferentially arrayed vanes 36 have leading and trailing extremities 37 and 38 and extend generally radially between the centerbody 30 and a turbine exhaust case (TEC) 40. Each of the vanes may be an assembly of a leading main body portion 42 and a trailing edge box 44. The vanes have circumferentially opposite first and second sides 46 and 48 (FIG. 2). The trailing edge box 44 may contain a spray bar (discussed below) for introducing the additional fuel 19. The centerbody may contain a burner 50 for combusting fuel to, in turn, initiate combustion of the fuel 19. The burner 50 and spray bars may be supplied from one or more supply conduits (not shown) extending through or along one or more of the vanes to the centerbody. As so far described, the engine configuration may be one of a number of existing engine configurations to which the present teachings may apply. However, the teachings may also apply to different engine configurations.

Figure 3:
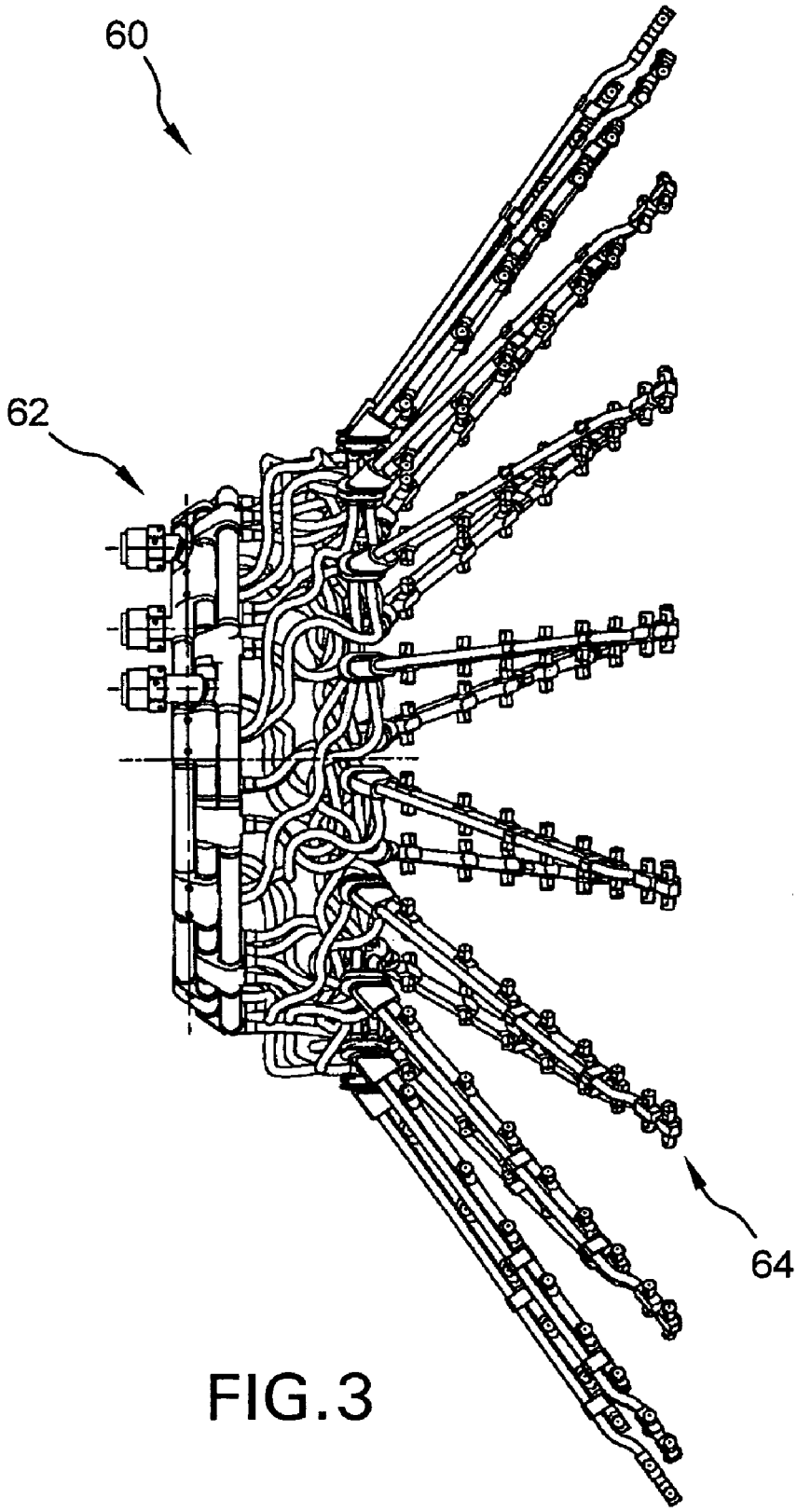
FIG. 3 is a side view of a spray bar array and fueling manifold of the augmentor of FIG. 2.
Figure 4:
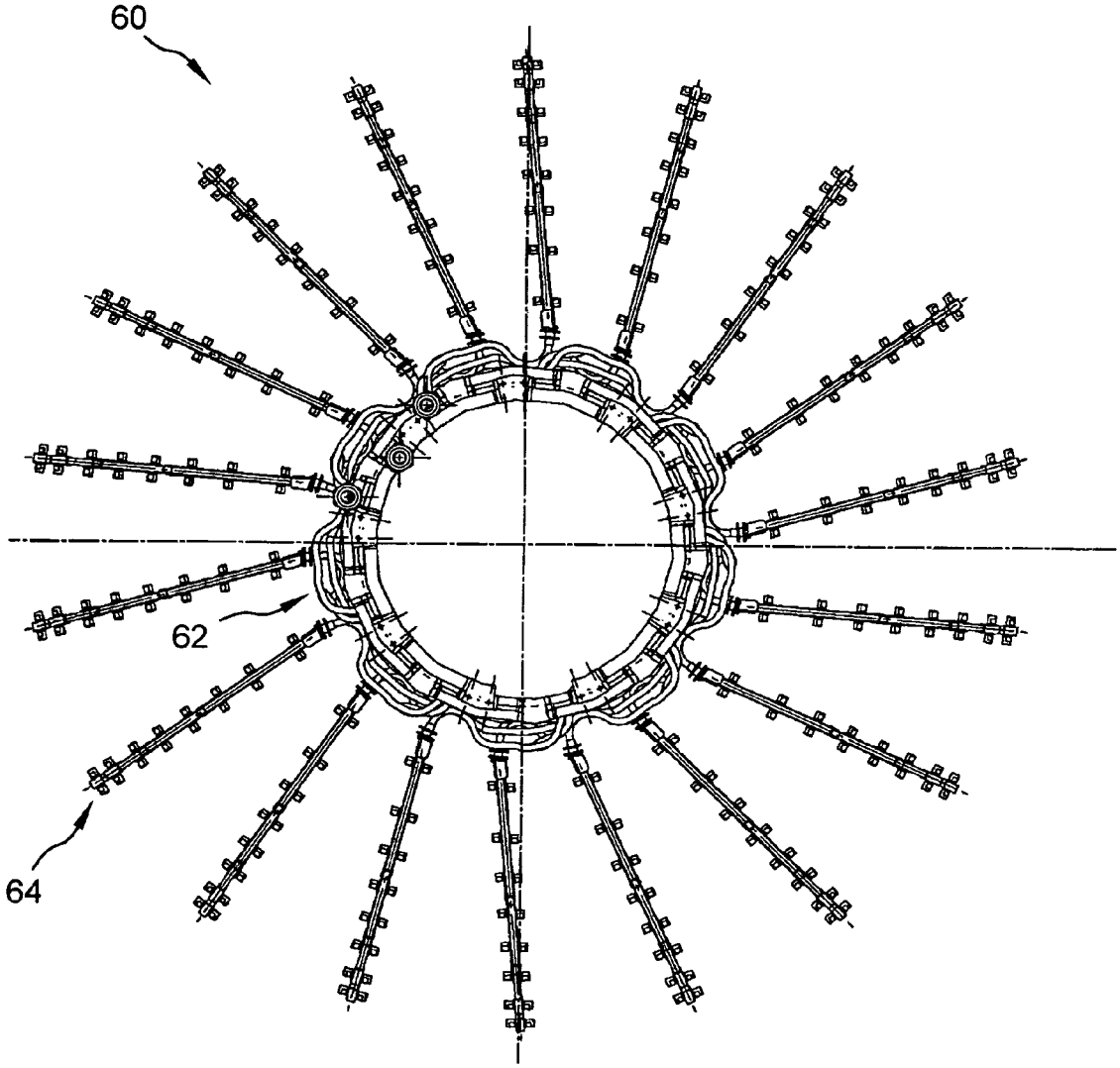
FIG. 4 is a front view of the spray bar array and manifold of FIG. 3.
Figure 5:
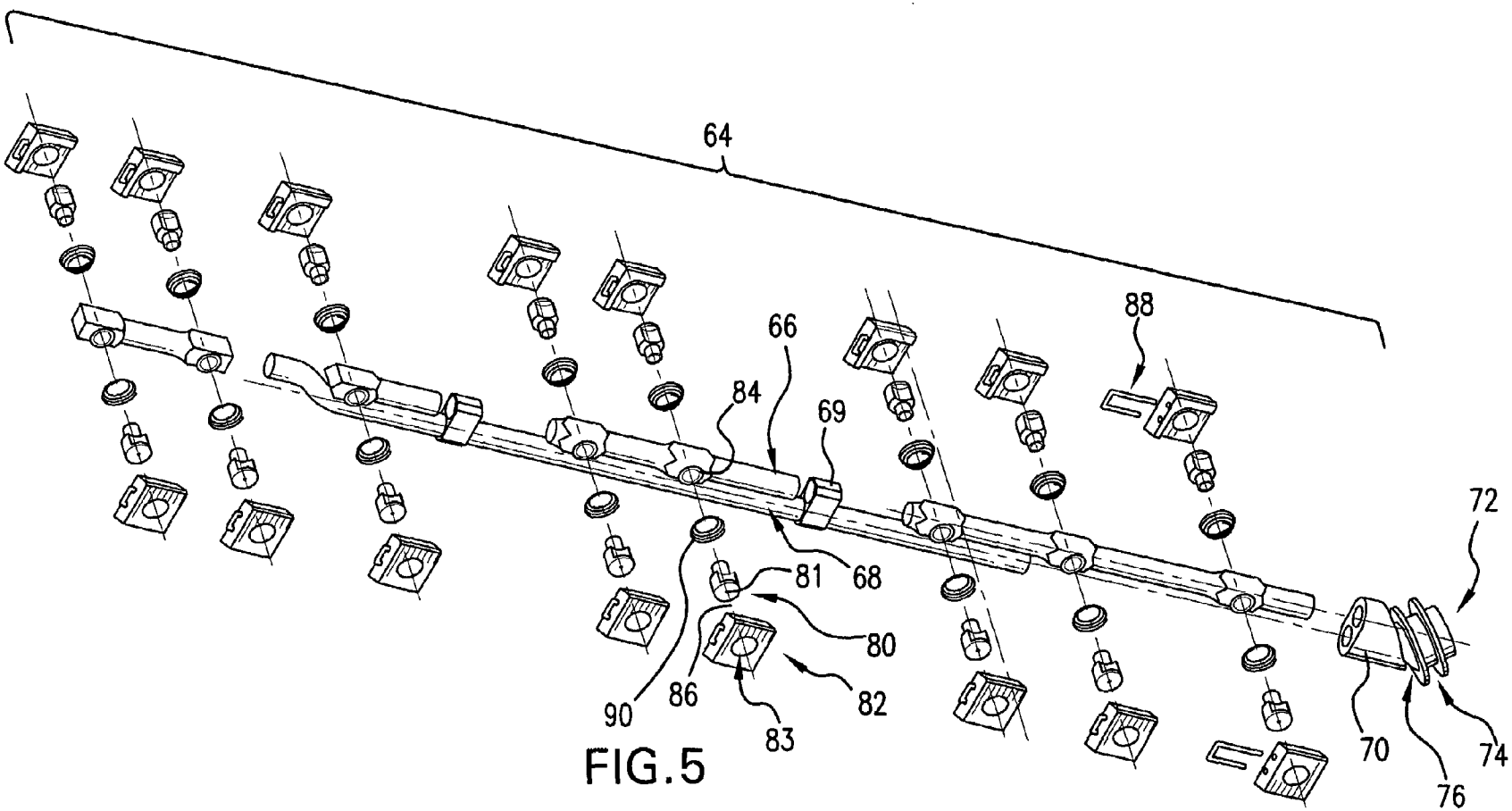
FIG. 5 is a partially exploded view of a spray bar of the array of FIGS. 3 and 4.

FIGS. 3 and 4 show portions of an augmentor fueling system 60 including a manifold 62 for feeding fuel to an array of spray bars 64. The manifold 62 may be located within the centerbody 30. FIG. 5 shows further details of an exemplary spray bar 64. The exemplary spray bar is a dual conduit spray bar having first and second conduits 66 and 68. The conduits 66 and 68 are secured to each other by blocks 69 having a pair of apertures respectively receiving the conduits. The conduits have proximal end portions mounted to outlets of a spray bar block 70 (e.g., by brazing or welding). The block 70 has an inboard end 72 bearing inlets for connection to the manifold 62. The exemplary block 70 includes inboard and outboard slots 74 and 76. The inboard slot 74 receives a seal (not shown) for engaging the centerbody structure. The outboard slot 76 receives first and second side halves of the associated vane. Each of the spray bars carries a plurality of nozzles 80 and wear blocks 82. Each nozzle has an aperture 81 for discharging an associated jet of fuel. Each wear block has a central aperture 83 which receives the associated nozzle 80. Whereas prior art systems provide wear blocks, nozzles, and spray bars as unitary or integrated (e.g., by welding or brazing) structures, the exemplary wear blocks 82 are otherwise formed. In the exemplary embodiment, each of the nozzles 80 is integrated (e.g., by brazing or welding) with an associated boss 84 of the associated conduit 66 or 68. The wear block 82, however, is formed of a material that wears preferentially relative to adjacent material of the vane and nozzle. The wear block 82 may be mounted for reciprocal motion along a nozzle axis 86 by means of a retainer 88. A spring 90 (e.g., compressed between the block 82 and the associated conduit) may bias the block 82 outward. In addition to wearing preferentially to mating details, the electrographitic material used for the wear members may deposit a thin layer of graphite at the wear interface. This deposition may serve to further reduce the rates of wear.

Figure 6:
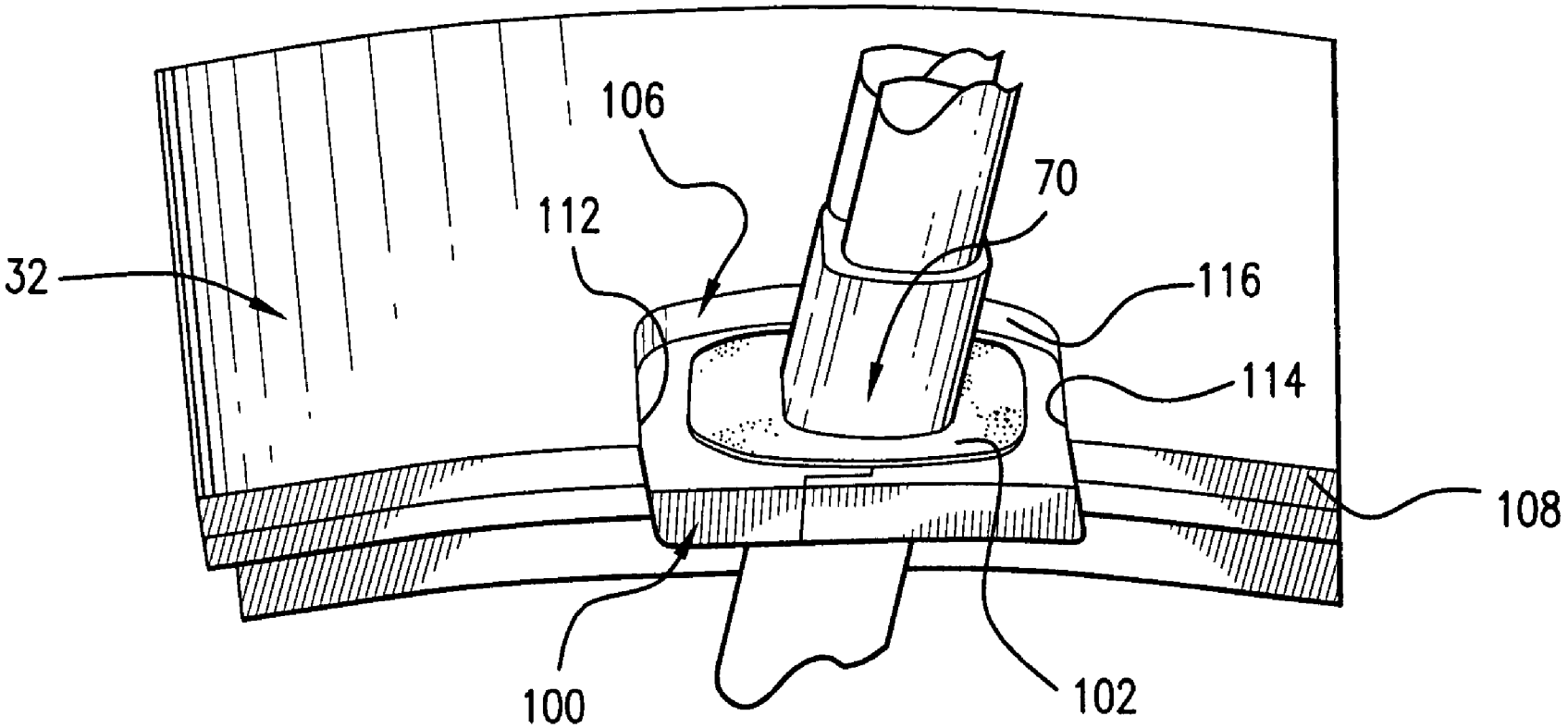
FIG. 6 is an aft view of a spray bar-to-centerbody seal.
Figure 7:
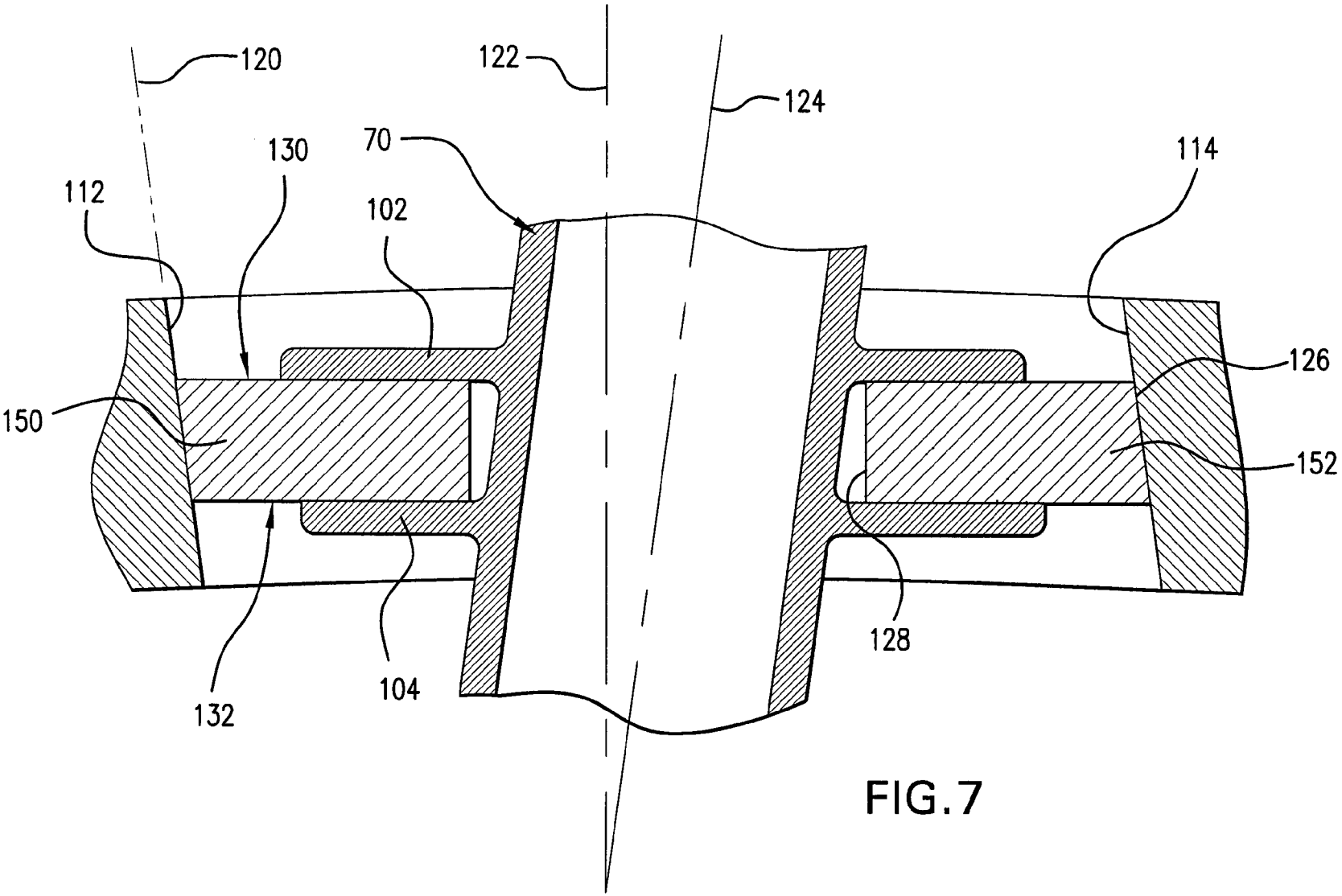
FIG. 7 is a transverse sectional view of the seal of FIG. 6.

FIG. 6 shows further details of a seal 100 sealing a spray bar 64 to the centerbody 30. As noted above, the seal encircles the spray bar and is captured in the slot 74 of FIG. 5. The slot 74 is between a first flange 102 and a second flange 104 (FIG. 7) inboard thereof. The spray bar 64 passes through an aperture in the centerbody shell and the seal 100 is accommodated within the aperture. The aperture is formed by the combination of a recess 106 extending forward/upstream from an aft/downstream rim 108 of the centerbody main portion 32 on the one hand and a forward rim 110 (FIG. 1) of the tailcone 34 (removed in FIG. 6 to show the seal) on the other hand. The recess 106 has first and second lateral surfaces 112 and 114 and a forward/upstream end surface 116 forming respective associated surfaces of the aperture. The tailcone forward rim 110 (not shown in FIG. 6) forms the aperture downstream surface. In cross-sectional planform, the aperture and recess 106 are half obround, with the sides 112 and 114 being straight and the end 106 being semicircular. The sides 112 and 114 are parallel to each other and have a direction 120 in a transverse plane. In the exemplary embodiment, this direction 120 is non-parallel to both a local radial direction 122 and a local direction 124 of the conduit length. Specifically, the directions 120 and 124 are off radial in opposite directions as is discussed below.

The periphery 126 of the seal 100 is complementary to the centerbody aperture to permit the seal to move reciprocally within the aperture (e.g., in the direction 120). The exemplary periphery is thus a non-right, non-circular, cylinder surface. A seal central aperture surface 128 may be complementary to a cross-section of the block 70 between the flanges 102 and 104. The seal 100 has outboard and inboard surfaces or faces 130 and 132.

Figure 8:
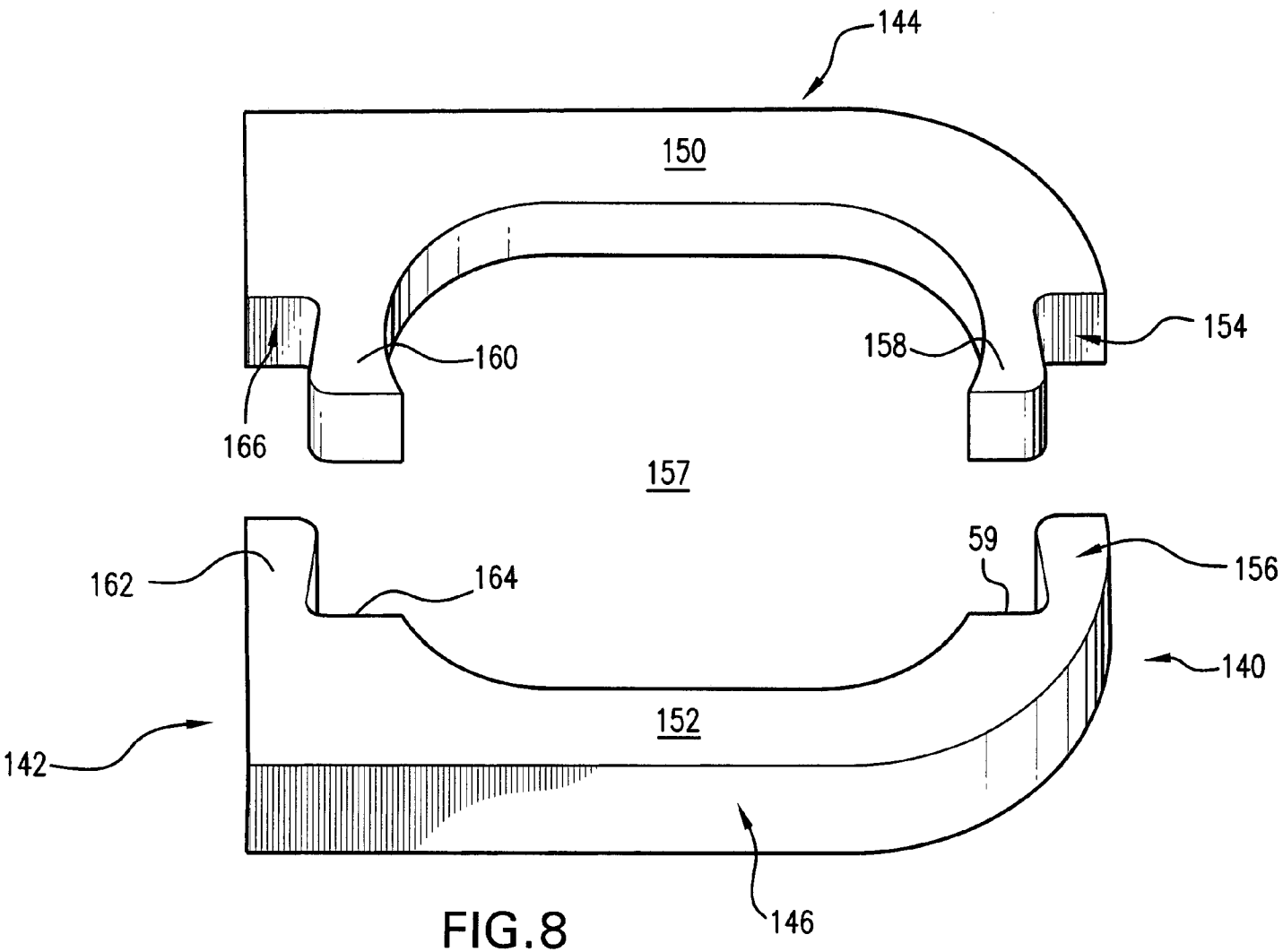
FIG. 8 is an exploded view of the seal of FIG. 6.

The exemplary seal 100 is formed of two pieces in snap-fit, backlocking, engagement. FIG. 8 shows further details of the exemplary seal 100. The seal 100 has upstream and downstream ends 140 and 142 respectively semi-circular and flat as noted above for engaging the associated aperture surfaces 116 and 110. The seal 100 also has first and second sides 144 and 146 for respectively engaging the aperture/recess first and second sides 112 and 114. The exemplary seal is formed in first and second pieces 150 and 152. At the forward/upstream end 140, the first piece 150 has a rebate or notch 154 receiving a corresponding projection 156 of the second piece. Immediately aft/downstream thereof and extending to the seal central aperture 157, the first piece 150 has a projection 158 received by a rebate 159 in the second piece. These projections/rebates form a half dovetail backlocked interfitting connection resisting transverse separation of the two seal halves 150 and 152. Similarly, at the rear of the seal there are projections 160 and 162 received by rebates or notches 164 and 166. The two halves may be snapped into engagement around the block 70, with elastic deformation of the halves permitting an over-center snap fit engagement. The snap fit engagement may be reversible by unsnapping. In alternative embodiments (e.g., of barbed rather than half dovetail engagement) the engagement may be irreversible, requiring destructive removal of the seal. Other embodiments (e.g., requiring release tools for nondestructive removal) are possible. When the seal halves 150 and 152 are installed around the spray bar, the proximity of the flanges 102 and 104 prevents separation of the seal halves by relative translation in the direction 124.

Exemplary seal material is a substantially monolithic electro-graphitic carbon. With exemplary centerbody and tailcone material being a nickel-based superalloy, electro-graphitic carbon has an advantageous preferential wear property. Additionally, the electro-graphitic carbon has advantageous temperature stability relative to polymers and other non-metallic sacrificial wear materials used in other applications. Thus, as thermal cycling, vibration, and the like cause relative motion of the seal and centerbody, the seal will preferentially wear. Eventually, the wear will be sufficient to require seal replacement. Alternative seals may be other than monolithic (e.g., having a metallic core carrying an electro-graphitic carbon exterior portion). The seals need not prevent all leakage. Especially as time passes, there will be gaps between the seals and their associated centerbody apertures. However, the effect of the seals is to reduce the magnitude flow through the apertures relative to what would occur in their absence.

One or more embodiments of the present invention have been described. Nevertheless, it will be understood that various modifications may be made without departing from the spirit and scope of the invention. Accordingly, other embodiments are within the scope of the following claims.

What is claimed is:

1. A turbine engine augmentor comprising:

a centerbody within a gas flowpath from upstream to downstream and comprising:

upstream and downstream shell sections, a downstream rim of the upstream shell section meeting an upstream rim of the downstream shell section;

a plurality of vanes positioned in the gas flowpath outboard of the centerbody;

an augmentor spray bar fuel conduit extending through the centerbody and a first of the vanes to deliver fuel to the centerbody; and a seal mounted to the spray bar and positioned in a recess extending from at least one of the downstream rim of the upstream shell section and upstream rim of the downstream shell section and comprising:

a first portion; and a second portion engaging the first portion in a backlocked interfitting engagement.

2. The turbine engine augmentor of claim 1 wherein the seal periphery is shaped essentially as a non-right non-circular cylinder.

3. The turbine engine augmentor of claim 1 wherein a planform of the seal is characterized by a straight first end, an at least partially rounded second end, and first and second straight sides.

4. The turbine engine augmentor of claim 3 wherein the seal planform second end is semicircular.

5. The turbine engine augmentor of claim 3 wherein the seal planform first end seals against the upstream rim of the downstream shell section.

6. The turbine engine augmentor of claim 1 wherein the seal comprises electro-graphitic carbon.

7. The turbine engine augmentor of claim 1 wherein the downstream shell section is a tailcone.

8. A turbine engine augmentor comprising:

a centerbody within a gas flowpath from upstream to downstream and comprising:

upstream and downstream shell sections, a downstream rim of the upstream shell section meeting an upstream rim of the downstream shell section;

a plurality of vanes positioned in the gas flowpath outboard of the centerbody;

an augmentor spray bar fuel conduit extending through the centerbody and a first of the vanes to deliver fuel to the centerbody; and a seal mounted to the spray bar and positioned in a recess extending from at least one of the downstream rim of the upstream shell section and upstream rim of the downstream shell section and comprising an electro-graphitic carbon material.

9. The turbine engine augmentor of claim 8 wherein the seal comprises:

a first portion; and a second portion engaging the first portion in a backlocked interfitting.

10. The turbine engine augmentor of claim 8 wherein the seal consists essentially of first and second pieces of said electro-graphitic carbon material in snap-fit engagement to each other.

* * * * *

UNITED STATES PATENT AND TRADEMARK OFFICE

CERTIFICATE OF CORRECTION

PATENT NO. : 7,578,131 B2
APPLICATION NO. : 11/174378
DATED : August 25, 2009
INVENTOR(S) : Muldoon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 224 days.

Signed and Sealed this

Seventh Day of September, 2010

David J. Kappos

David J. Kappos
*Director of the United States Patent and Trademark Office*